US006874423B2

(12) United States Patent
Heeke

(10) Patent No.: US 6,874,423 B2
(45) Date of Patent: Apr. 5, 2005

(54) HERMETICALLY SEALED ELECTRICAL FEED-THROUGH DEVICE WITH A STRAIGHT ISOLATED PIN IN AN OFFSET OVAL GLASS SEAL

(75) Inventor: Neil Heeke, Golden, CO (US)

(73) Assignee: Schott Glas, Mainz (DE)

( * ) Notice: Subject to any disclaimer, the term of this patent is extended or adjusted under 35 U.S.C. 154(b) by 79 days.

(21) Appl. No.: 10/279,491

(22) Filed: Oct. 21, 2002

(65) Prior Publication Data

US 2004/0075260 A1 Apr. 22, 2004

(51) Int. Cl.[7] ..... F42B 5/145; F42C 11/00; F42C 19/06; F42C 19/12

(52) U.S. Cl. ..... 102/202.12; 102/202; 102/202.5; 102/202.9

(58) Field of Search ..... 102/202.12, 202.9; 280/737, 741; 174/110 R, 50.56, 50.61; 361/302; 65/36

(56) References Cited

U.S. PATENT DOCUMENTS

| | | | | | |
|---|---|---|---|---|---|
| 3,288,742 | A | * | 11/1966 | Donatelli | 156/293 |
| 3,539,704 | A | * | 11/1970 | Gill et al. | 174/52.4 |
| 3,638,076 | A | * | 1/1972 | Koons | 361/518 |
| 3,974,424 | A | * | 8/1976 | Lee | 361/248 |
| 4,430,376 | A | | 2/1984 | Box | 428/174 |
| 4,621,578 | A | * | 11/1986 | Vallieres et al. | 102/202.9 |
| 4,678,358 | A | | 7/1987 | Layher | 403/28 |
| 4,788,382 | A | | 11/1988 | Ahearn et al. | 174/52 |
| 5,157,831 | A | * | 10/1992 | Wang et al. | 29/876 |
| 5,230,287 | A | * | 7/1993 | Arrell et al. | 102/202.5 |
| 5,243,492 | A | | 9/1993 | Marqui et al. | 361/247 |
| 5,431,101 | A | * | 7/1995 | Arrell et al. | 102/202.5 |
| 5,556,132 | A | * | 9/1996 | Sampson | 280/741 |
| 5,709,724 | A | | 1/1998 | Naugler et al. | 65/59.4 |
| 5,772,243 | A | | 6/1998 | Green et al. | 280/741 |
| 5,932,832 | A | * | 8/1999 | Hansen et al. | 102/202.4 |
| 5,971,818 | A | * | 10/1999 | Juntwait et al. | 439/866 |
| 5,988,069 | A | * | 11/1999 | Bailey | 102/202.9 |
| 6,073,963 | A | * | 6/2000 | Hamilton et al. | 280/741 |
| 6,111,198 | A | * | 8/2000 | Tower | 174/50.56 |
| 6,167,808 | B1 | * | 1/2001 | Mramor | 102/202.9 |
| 6,274,252 | B1 | | 8/2001 | Naugler et al. | 428/621 |
| 6,302,023 | B1 | * | 10/2001 | Wier | 102/202.2 |
| 6,446,557 | B1 | * | 9/2002 | Lubbers | 102/202.9 |
| 6,586,675 | B1 | * | 7/2003 | Bealka et al. | 174/50.56 |
| 6,644,206 | B2 | * | 11/2003 | Fogle, Jr. | 102/530 |
| 6,693,242 | B1 | * | 2/2004 | Bailey | 174/152 R |

FOREIGN PATENT DOCUMENTS

| | | | | |
|---|---|---|---|---|
| FR | 2560983 A1 | * | 9/1985 | F42C/19/12 |
| FR | 2560984 A1 | * | 9/1985 | F42B/3/14 |

* cited by examiner

*Primary Examiner*—Michael J. Carone
*Assistant Examiner*—Daniel L. Greene, Jr.
(74) *Attorney, Agent, or Firm*—Michael J. Striker

(57) ABSTRACT

The hermetically sealed electrical feed-through device has a circular metal disk (11) with a conductive straight isolated pin (13) hermetically sealed in an oval or elliptical through-going opening (O) positioned offset from the center of the circular metal disk. The straight isolated pin (13) is sealed in the opening (O) by means of a glass-to-metal seal (17). A conductive straight ground pin (15) is connected to the rear side of the circular metal disk (11) adjacent to the opening (O) and extends approximately parallel to the straight isolated pin (13). Because the through-going opening (O) has an elliptical or oval cross-section, a wider range of different bridge wires of different lengths, which are connectable on the front side of the metal disk (11) between the front surface of the metal disk (11) and the straight isolated pin (13), is possible. The straight isolated and ground pins have circular transverse cross-sections.

6 Claims, 1 Drawing Sheet

HERMETICALLY SEALED ELECTRICAL FEED-THROUGH DEVICE WITH A STRAIGHT ISOLATED PIN IN AN OFFSET OVAL GLASS SEAL

CROSS-REFERENCES

The present invention contains subject matter in common with a co-pending U.S. patent application entitled: HERMETICALLY SEALED ELECTRICAL FEED-THROUGH DEVICE WITH AN OVAL-CROSS-SECTIONED ISOLATED PIN IN A CIRCULAR GLASS SEAL and another co-pending U.S. patent application entitled: HERMETICALLY SEALED ELECTRICAL FEED-THROUGH DEVICE WITH A BENT ISOLATED PIN IN A CIRCULAR GLASS SEAL, filed on or about the same time as the present application.

BACKGROUND OF THE INVENTION

1. Field of the Invention

The present invention relates to a hermetically sealed electrical feed-through device, especially for an initiator or squib of an air bag igniter.

2. Description of the Related Art

Air bag systems used for protecting the passengers of a motor vehicle during a collision include an inflatable bag mounted in the dashboard or steering wheel, gas generators for the explosive generation of gas to inflate the bag, acceleration sensors to generate an electrical signal indicative of a collision and an igniter responsive to the acceleration sensors for ignition of a trigger charge in a hollow chamber that, in turn, ignites a main charge to produce the gas that inflates the bag.

The igniter for an air bag system comprises a so-called header or squib. The squib or header, as described for example in U.S. Pat. No. 5,243,492 and U.S. Pat. No. 5,772,243, comprises a hermetically sealed electrical feed-through device for supplying a current into the hollow chamber containing the trigger charge and a thin bridge wire electrically connected across the electrical feed-through device. The bridge wire ignites the trigger charge when a sufficient electrical current is passed through it via the feed-through device. Hermetically sealed electrical feed-through devices are also used for other types of devices.

In methods of manufacturing the hermetically sealed electrical feed-through devices of the prior art, as described in U.S. Pat. No. 5,709,724, U.S. Pat. No. 6,274,252, U.S. Pat. No. 5,243,492, U.S. Pat. No. 5,157,831, U.S. Pat. No. 4,678,358 and U.S. Pat. No. 4,430,376, a metal isolator body or plug is provided with a circular through-going opening or a metal eyelet is provided with a circular cavity. A conductive pin, called the isolated pin, is hermetically sealed in the through-going opening or cavity by means of a glass-to-metal seal.

Glass-to-metal seals may be of the compression variety, in which advantage is taken of the difference in the thermal expansion properties of metal and glass, or may be due to molecular bonding, as described in U.S. Pat. No. 5,709,724 and U.S. Pat. No. 6,274,252.

A hermetically sealed feed-through device is made with a glass-to-metal compression seal by cutting an appropriately sized glass preform having a suitable coefficient of thermal expansion with a central hole, arranging the glass preform in a through-going opening in a metal disk or in a cavity in a metal eyelet, inserting the conductive isolated pin in the hole in the preform, heating the assembly to an elevated temperature over the softening point of the glass perform and then cooling the entire assembly, whereby the metal disk or eyelet contracts more than the glass. A ground pin may be connected to the metal disk or the eyelet approximately parallel to the isolated pin as described in U.S. Pat. No. 5,243,492.

The isolated pin and/or the ground pin may also be provided with a noble metal coating to protect against corrosion, as described in U.S. Pat. Nos. 4,788,382 and 5,157,831.

The resulting electrical feed-through devices can be used to make the headers or squibs for the air bag igniter, for example, by connecting the bridge wire across the glass seal between the isolated pin on the front side of the electrical feed-through device and the body of the eyelet or metal disk.

The conductive pins in the prior art electrical feed-through devices are circular cross-sectioned and the through-going opening or cavity in the prior art metal ring or eyelet is circular. Disadvantageously only bridge wires of a comparatively narrow range of lengths can thus be connected across the front side of the electrical feed-through device to make a squib or initiator, e.g. for an air bag, because the isolated pin is placed centrally in the through-going opening in the metal ring or eyelet during assembly. Thus different embodiments of the electrical feed-through devices with different sized through-going openings and different diameter isolated pins must be manufactured e.g. for different air bag system manufacturers or for different initiator or squib manufacturers. This results in comparatively large manufacturing costs including storage, distribution and fixturing expenses, because of the various different types of hermetically sealed electrical feed-through devices for the different initiators.

SUMMARY OF THE INVENTION

It is an object of the present invention to provide an improved hermetically sealed electrical feed-through device, especially for an initiator or squib for an air bag ignition system, which does not suffer from the above-described disadvantages.

It is also an object of the present invention to provide a universal hermetically sealed electrical feed-through device for an initiator or squib for an air bag inflation system of the above-described type having at least one bridge wire, that accommodates a greater range of bridge wire lengths, so that different manufacturers of squibs or initiators having different bridge wire requirements can use the same embodiment of the electrical feed-through device according to the invention.

It is another object of the invention to provide a hermetically sealed electrical feed-through device of the above-described type in which a conductive pin is sealed in a through-going opening by means of a glass seal, in which strain distribution is uniform throughout the glass seal.

According to the invention a hermetically sealed electrical feed-through device comprises an electrically conductive body with an oval or elliptical through-going opening, which has a front side and a rear side and in which the oval or elliptical through-going opening is positioned offset from a center of the electrically conductive body;

an electrically conductive straight isolated pin hermetically sealed centrally in the oval or elliptical through-going opening by means of a glass seal, so that the straight isolated pin projects outward from the rear side of the electrically conductive body and so that one end of the straight isolated pin is accessible from or exposed on the front side of the electrically conductive body; and an electrically conductive straight ground pin connected with the rear side of the electrically conductive body adjacent to the oval or elliptical through-going opening, the electrically conductive straight ground pin projecting outward from the rear side of the electrically conductive body at least approximately parallel to the isolated pin;

wherein the oval or elliptical through-going opening has a major axis and a minor axis such that different bridge wires of different lengths are connectable between the front side of the electrically conductive body and the one end of the straight isolated pin accessible from or exposed on the front side of the electrically conductive body.

The electrical feed-through device according to the invention has the great advantage that it permits a wider range of bridge wire lengths for one or more bridge wires connected across the front side of the feed-through device, because the through-going opening in the electrically conductive body has an oval or elliptical cross-section. The manufacture of a single type of electrical feed-through device thus accommodates the needs of a larger number of different manufacturers who use the electrical feed-through device to e.g. manufacture squibs or initiators for inflation devices for air bags. A lower price for the feed-through device results because of the higher volumes due to reduced component types.

In addition, the same length bridge wire can advantageously be welded in each of the four quadrants of the glass seal. Double bridge wires can easily be welded simultaneously. Furthermore the symmetrical shape of the seal area produces balanced strain distribution in the glass. A thinner head can be produced with a glass seal having the same or greater strength.

In a preferred embodiment of the invention the electrically conductive body is a circular metal disk, or eyelet, and the straight isolated pin and the straight ground pin consist of metal and have a circular transverse cross-section, so that manufacture of the feed-through is simplified.

The straight ground pin is preferably shortened relative to the straight isolated pin, so that free ends of the isolated pin and the ground pin are at least approximately at an identical distance from the rear side of the circular metal disk.

The exposed end surface of the straight isolated pin, the front surface of the glass seal and the front surface of the circular metal disk are preferably approximately or exactly even with each other, or are approximately or exactly coplanar.

Manufacture and assembly of the electrical feed-through is comparatively easier because the isolated pin and the ground pin are both straight. However in order to use straight pins, the through-going hole must be offset from center in the circular metal disk. If the outside/inside diameters are kept the same, neither a special profile nor pressing is required to seal the assembly. The opening in the glass preform used to make the glass seal advantageously has the same diameter as in the glass preform of the prior art, but the outside shape of the glass preform is changed to elliptical or oval.

Fixturing costs will be reduced due to the fewer types of embodiments and because of the use of straight pins. Raw material costs are reduced because cold forming or metal injection molding can be used to make the circular metal disk or eyelet. Also the higher component production quantities reduce raw material costs.

BRIEF DESCRIPTION OF THE SEVERAL VIEWS OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
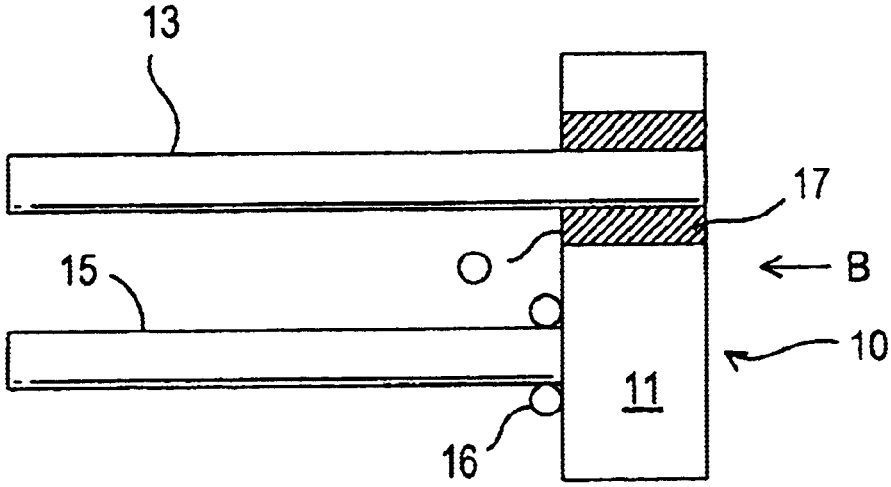
FIG. 1 is a longitudinal cross-sectional view through a first embodiment of the electrical feed-through device according to the invention taken along the section line A—A in FIG. 2.

A single straight pin embodiment of the electrical feed-through device according to the invention is shown in the drawing.

Figure 2:
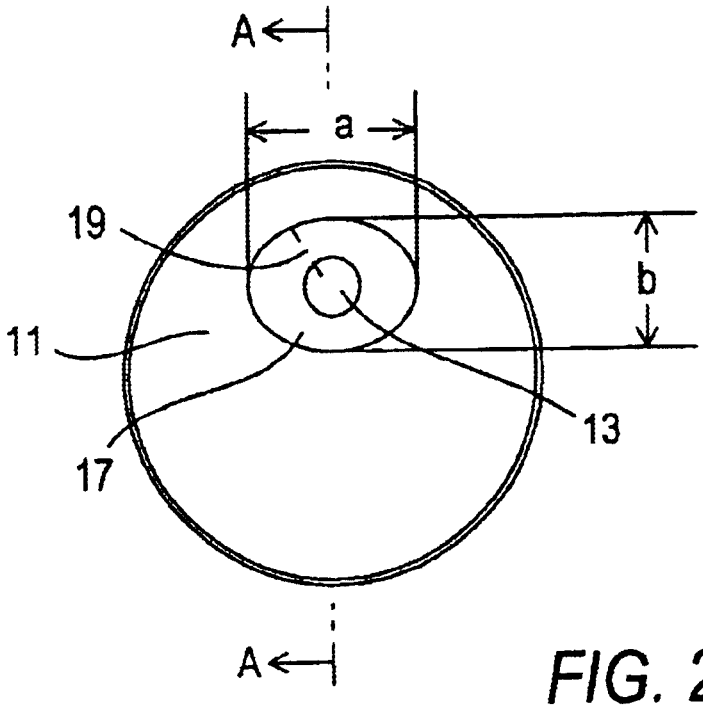
FIG. 2 is a front elevation view of the electrical feed-through device shown in FIG. 1 in the direction indicated by the arrow B in FIG. 1.

FIGS. 1 and 2 show a straight pin embodiment 10 of the hermetically sealed electrical feed-through device. This electrical feed-through device includes a circular metal disk 11 provided with an oval or elliptical through-going hole or opening O offset from the center of the metal disk 11. The term "offset" means that the center of the oval or elliptical through-going hole O does not coincide with the center of the circular metal disk 11. The center of the oval or elliptical through-going hole or opening O is approximately half the distance from the center of the circular metal disk 11 and the edge of the metal disk in the embodiment shown in the drawing.

A straight isolated pin 13 projects outward and rearward from the back of the circular metal disk 11. The isolated pin 13 is sealed in the oval or elliptical opening O in the circular metal disk or eyelet 11 with a glass seal 17. The glass seal 17 fills the space between the isolated pin 13 and the metal disk 11 in the offset oval or elliptical opening O. The isolated pin 13 has a circular transverse cross-section. The center of the front surface of the isolated pin 13 is arranged at least approximately at the center of the oval or elliptical opening O in the embodiment shown in the drawing.

A straight ground pin 15 projects outward and rearward from the rear side of the circular metal disk 11 in an axial direction B indicated e.g. with the arrow in FIG. 1 shown on the front side of the eyelet 11 in FIG. 1. The ground pin 15 is attached to the rear surface of the circular metal disk or eyelet 11 with braze ring 16 and is also called the braze pin.

Both the isolated pin 13 and the ground pin 15 are made of an electrically conductive material, such as metal, e.g. nickel-iron, and may be plated with another metal, such as palladium or gold, to provide corrosion protection.

In the embodiment shown in FIGS. 1 and 2 the isolated pin 13 and the ground pin 15 extend from the rear of the circular metal disk 11 and are parallel to each other. They are arranged on opposite sides of the central axis of the circular metal disk 11. The ground pin 15 is shorter than the isolated pin 13 so that the free ends of both pins are approximately an identical distance from the rear side of the circular metal disk 11. In the embodiment shown in FIGS. 1 and 2 the end of the isolated pin 13 inserted in the glass seal 17 is more or less even or flush with the front surface of the circular metal disk 11 and the glass seal 17. In this embodiment the respective front surfaces of the circular metal disk 11, the glass seal and the exposed end of the isolated pin 13 are substantially or exactly coplanar.

In use as part of an igniter a fine metal wire 19 (shown with dashed lines in FIG. 2) extends across the front of the circular metal disk 11 and electrically connects the isolated pin 13 with the ground pin 15. The area across the front of the metal disk 11 where the fine metal wire 19 is connected is called the bridge area, since the fine bridge wire 19 bridges the gap between the two pins. However the fine bridge wire 19 is not part of the present invention, and thus is shown with dashed lines. The electrical feed-through device is marketed separately without the fine bridge wire 19 to various manufacturers of the initiator or squib for the air bag inflation device. Conceivably the electrical feed-through device could have other applications besides air bag igniters.

The same hermetically sealed electrical feed-through device according to the present invention can be marketed to different manufacturers that require different lengths of the line bridge wire 19 in their different igniter devices for different air bag apparatus, because the distance between the respective front surfaces of the isolated pin 13 and the circular metal disk 11 varies because the through-going hole, and thus the glass seal 17, is elliptical or oval instead of circular. Thus the hermetically sealed electrical feed-through device of the present invention is advantageously a universal electrical feed-through device for air bag igniters of different manufacturers because the length of the bridge wires that can be used with it can vary over a wider range than in the case of prior art feed-through devices.

As shown in FIG. 2, there is a longer bridge area in which the distance across the glass seal 17 is greatest on the surface of the header assembly, corresponding to the major axis of the elliptical opening. There is also a shorter bridge area on the surface of the header assembly in which the distance across the glass seal 17 is the least, corresponding to the minor axis of the elliptical opening. The fine bridge wire 19 is shown in FIG. 2 at a position, where the distance across the glass seal is in between the shortest and the longest distance.

Thus the same hermetically sealed electrical feed-through device can be marketed to different manufacturers, who require different lengths of fine bridge wire 19 in their different igniter devices. Thus the hermetically sealed electrical feed-through device of the present invention is advantageously a universal feed-through device for air bag igniters of different manufacturers. In addition, the same length bridge wires can be welded in all four quadrants of the glass seal. This is because a bridge wire can be connected extending from the isolated pin to a point on the metal disk 11 to the left of the minor axis of the opening O in the upper left quadrant as shown in FIG. 2 or to a point on the metal disk 11 to the right of the minor axis in the upper right quadrant or to respective points to the right or left of the minor axis in the lower quadrants shown in FIG. 2 (the quadrants of the glass seal are of course defined in relation to axes having an origin at the center of the glass seal as shown in FIG. 2).

For example, the major axis a of the elliptical hole can range from 3.02 to 3.07 cm and the minor axis b of the elliptical hole can range from 2.26 to 2.31 cm. The distance of the center of the front surface of the isolated pin 13 from the center of the circular metal disk 11 is about 1.5 cm and the distance between the pins is about 3.0 cm.

The glass seal 17 of the hermetically sealed electrical feed-through device of the present invention may be made by the methods disclosed in background section of the invention, especially those disclosed in U.S. Pat. No. 6,274,252 and U.S. Pat. No. 5,709,724. The inventive improvements in the feed-through devices claimed below reside primarily in the geometries selected for the pin cross-sections and/or the through-going openings.

While the invention has been illustrated and described as embodied in a hermetically sealed electrical feed-through device, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A hermetically sealed electrical feed-through device comprising an electrically conductive body (11) provided with an oval or elliptical through-going opening (O), said electrically conductive body having a front side and a rear side and said oval or elliptical through-going opening (O) being arranged offset from a center of said electrically conductive body (11);

an electrically conductive straight isolated pin (13) hermetically sealed centrally in said oval or elliptical through-going opening (O) by means of a glass seal (17), so that said straight isolated pin (13) projects outward from said rear side of said electrically conductive body and so that one end of the straight isolated pin is accessible from or exposed on said front side of said electrically conductive body (11); and an electrically conductive straight ground pin (15) connected with the rear side of the electrically conductive body (11) adjacent to said oval or elliptical through-going opening, said electrically conductive straight ground pin (15) projecting outward from the rear side of the electrically conductive body (11) approximately parallel to the isolated pin;

wherein the oval or elliptical through-going opening (O) has a major axis (a) and a minor axis (b) such that different bridge wires of different lengths are connectable between the front side of the said electrically conductive body (11) and the one end of the straight isolated pin (13) accessible from or exposed on the front side of the electrically conductive body (11).

2. The hermetically sealed electrical feed-through device as defined in claim 1, wherein said electrically conductive body (11) is a circular metal disk.

3. The hermetically sealed electrical feed-through device as defined in claim 2, wherein said straight isolated pin (13) and said straight ground pin (15) are each made of metal and have a circular transverse cross-section, and wherein said straight ground pin (15) is shortened relative to said straight isolated pin (13), so that free ends of said isolated pin and said ground pin are substantially at an identical distance from the rear side of said circular metal disk.

4. The hermetically sealed electrical feed-through device as defined in claim 2, wherein said one end of Said straight isolated pin (13), said glass seal (17) and said front side or said circular metal disk have respective front surfaces that are at least approximately even with each other or at least approximately coplanar.

5. The hermetically sealed electrical feed-through device as defined in claim 2, wherein said straight ground pin (15) and the straight isolated pin (13) are arranged on opposite sides of said center of said circular metal disk.

6. The hermetically sealed electrical feed-through device as defined in claim 2, wherein said straight ground pin (15) is connected to said circular metal disk by a braze ring (16).

* * * * *